US006509683B2

(12) United States Patent
Lee

(10) Patent No.: US 6,509,683 B2
(45) Date of Patent: Jan. 21, 2003

(54) IMPLOSION PROOF PANEL IN CATHODE RAY TUBE

(75) Inventor: Tae Hoon Lee, Kyongsangbuk-do (KR)

(73) Assignee: LG Electronics Inc., Seoul (KR)

( * ) Notice: Subject to any disclaimer, the term of this patent is extended or adjusted under 35 U.S.C. 154(b) by 64 days.

(21) Appl. No.: 09/840,237

(22) Filed: Apr. 24, 2001

(65) Prior Publication Data

US 2002/0024291 A1 Feb. 28, 2002

(30) Foreign Application Priority Data

May 4, 2000 (KR) ..... 2000-24042

(51) Int. Cl.[7] ..... H01J 31/00
(52) U.S. Cl. ..... 313/477 R; 220/2.1 A
(58) Field of Search ..... 313/477 R, 479, 313/461, 404, 408, 422; 220/2.1 A, 2.3 A, 2.1 R

(56) References Cited

U.S. PATENT DOCUMENTS 4,021,850 A * 5/1977 Rogers ..... 313/477 R X
5,466,984 A * 11/1995 Gotoh ..... 313/477 R
5,536,996 A * 7/1996 Vijlbrief ..... 313/477 R X
5,606,377 A * 2/1997 Swank ..... 313/77 R
6,150,760 A * 11/2000 Tsuchiya et al. ..... 313/477 R X
6,259,206 B1 * 7/2001 Tsuchiya et al. ..... 313/477 R X

* cited by examiner

*Primary Examiner*—Ashok Patel
(74) *Attorney, Agent, or Firm*—Fleshner & Kim, LLP

(57) ABSTRACT

A panel structure for a Braun tube is described satisfying the following conditions:

$$Rdo/(USDd \times 1.767) \geqq 35 \text{ and } 0.7 \leqq (MMLHd/OAH) \leqq 0.9,$$

wherein Rdo denotes a radius of curvature of a panel in a cathode ray tube, USDd denotes a length of the effective surface part in a diagonal direction, MMLHd denotes a height from the seal edge line to the mold match line, and OAH denotes a total height of a panel, thereby suppressing implosion that occurs during or after fabrication of a Braun panel and securing an implosion proof characteristic.

4 Claims, 3 Drawing Sheets

IMPLOSION PROOF PANEL IN CATHODE RAY TUBE

BACKGROUND OF THE INVENTION

1. Field of the Invention

The present invention relates to a panel in a cathode ray tube, and more particularly, to a panel structure, which can secure an implosion proof characteristic by suppressing implosion caused by increased stress concentration at an upper portion of a panel coming from making the panel flatter during or after fabrication of the cathode ray tube.

2. Background of the Related Art

The cathode ray tube is a major component for displaying a picture in a display, such as a TV receiver or a computer monitor. FIG. 1 illustrates a side view with a partial cut away view of a related art color cathode ray tube.

Referring to FIG. 1, there is a fluorescent material screen 2 having red, green, and blue fluorescent materials coated thereon on an inside surface of the panel 1 fitted to a front face of the cathode ray tube, and a funnel 3 at a rear of the panel 1 welded to the panel 1, and an electron gun 4 in a neck portion 3*a* of the funnel 3. There is a shadow mask 6 fixed to a frame 7 near to the fluorescent material screen 2 inside of the panel 1 for selecting colors of electron beams 5 emitted from the electron gun 4. The frame 7 is hung from a sidewall of the panel 1 as support springs 8 fixed to the frame 7 are inserted in stud pins 9 fixed to the sidewall of the panel 1. There is an inner shield 10 fixed to one side of the frame 7 by fastening springs 11 for protecting the electron beams 5 traveling toward the fluorescent material screen 2 from external geomagnetism. There is a magnet 13 having a plurality of poles on an outer circumference of the neck portion 3*a* for correcting a traveling path of the electron beams 5 to hit onto a required fluorescent material exactly, and a reinforcing band 12 strapped around an outer circumference of the cathode ray tube for preventing implosion of the cathode ray tube caused by external impact during operation of the cathode ray tube. A structure of the panel 1 will be explained with reference to FIGS. 2 and 3. The panel 1 forms a front face of a vacuum container to maintain an inside space of the cathode ray tube in a vacuum for smooth traveling of the electron beams. FIG. 2 illustrates a section of key parts of a related art panel, showing a skirt part 28 bent backward from an effective surface portion 20.

Referring to FIG. 2, the panel 1 with the skirt part 28 has a fixed total height 27, with reference to which the skirt part 28 is divided into an upper part 22 inclusive of the effective surface part 20 having a radius of outward curvature divided by a mold match line 21, an intermediate part 24 from the mold match line 21 to a break line 23, and a lower part 26 from the break line 23 to the seal edge line 25. An edge of the effective surface part 20 in the upper part 22 transits to the skirt part 28 through curvatures R and R', bland curvatures, wherein the outside bland curvature R' is connected to the mold match line 21 at an upper part angle 'a' of approx. 5° to a vertical line, the intermediate part 24 has an intermediate part angle 'b' of approx. 1.5° to the vertical line from the mold match line 21 to a break line 23, and the lower part 26 has a lower part angle 'c' of approx. 3°~4° to a vertical line. Because the outward curved effective surface part of the related art panel, with a consequential curved fluorescent screen on the effective surface, distorts a picture on the fluorescent screen and provides a sensing quality, it is a trend that the effective surface of the panel is formed flatter, to increase a ratio of the height of the upper part greater.

In the meantime, referring to FIG. 3, the reinforcing band 32 strapped on an outside of the panel skirt part 28 is in general positioned starting from a boundary point of the bland curvature R' and the straight section of the upper part 22 of the skirt to entire intermediate part 24. The reinforcing band 32 has a section similar to a section of the panel skirt part 28, i.e., the reinforcing band 32 has a band body part 30 positioned at a lower part of the panel and a bent part 31 at the upper part 22 of the panel with reference to the mold match line 21 of the panel 1. The bent part 31 is bent at an angle identical to the angle 'a' of the upper part of the panel, and the band body part 30 is parallel to a cathode ray tube axis. The reinforcing band compresses the panel 1 to act against expansion acting outward during evacuation of the cathode ray tube in fabrication, to reduce a stress on the panel, which makes the structure stable.

However, while the related art cathode ray tube with the curved screen surface exhibits a maximum tension at a periphery of the effective surface part of the panel as stress concentrates thereto, since the flat cathode ray tube with a thickness of the effective surface relatively greater than the related art cathode ray tube exhibits a tension stress concentrated to the skirt part of the panel which is relatively thin, that makes the flat cathode ray tube weak for the stress, such that the suggested panel form and the reinforcing band have a problem of lacking for an actual implosion proof requirement.

The problem can be described in detail as follows.

In the strapping of the reinforcing band, with an inner circumferential length shorter than an outer circumferential length on the mold match line of the panel, on the skirt part of the panel, to exert a contract force to the panel, that generates a tension on the reinforcing band in return, it is required to strap the reinforcing band more tightly on the skirt part for utilizing the tension fixed by a thickness, a width, and a yielding strength of the reinforcing band itself. However, the increased gap between the reinforcing band and the upper part of the skirt of the panel caused by the increased length of the bent part in the upper part of the reinforcing band coming from the increased ratio of the upper part of the panel in the course of making the effective surface flatter makes the tight contact difficult. That is, the increased panel upper part in the panel skirt part makes the contact between the panel upper part and the reinforcing band poor, to deteriorate implosion proof design efficiency. Moreover, the shifting of a tension center on the reinforcing band to front according to the increased panel upper part may cause slip when the reinforcing band slips off the panel.

SUMMARY OF THE INVENTION

Accordingly, the present invention is directed to an implosion proof panel in a cathode ray tube that substantially obviates one or more of the problems due to limitations and disadvantages of the related art.

An object of the present invention is to provide an implosion proof panel in a cathode ray tube, which can enhance an implosion proof characteristic.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings. To achieve these and other advantages and in accordance with the purpose of the present invention, as embodied and broadly described, the implosion proof panel in a cathode ray tube, the cathode ray tube includes an effective surface part of a fluorescent screen formed on the panel, the panel with a substantially flat outside surface including, a skirt part starting from a periphery of the effective surface part to a seal edge line of the panel having an upper part, an intermediate part, and a lower part, the upper part and the intermediate part being divided by a mold match line, and a reinforcing band strapped around an outer circumference of the panel for preventing implosion of the cathode ray tube, wherein the panel meets the following conditions.

$$Rdo/(USDd\times 1.75)\geqq 35, \text{ and } 0.7\leqq(MMLHd/OAH)\leqq 0.9,$$

Where, Rdo denotes a radius of curvature of the outside surface of the panel in a diagonal direction, USDd denotes a length of the effective surface part of the panel in the diagonal direction, MMLHd denotes a height from the seal edge line to the mold match line of the panel, and OAH denotes a total height of the panel.

In another aspect of the present invention, there is provided an implosion proof panel in a cathode ray tube, the cathode ray tube including an effective surface part of a fluorescent screen formed on the panel, and the panel with a substantially flat outside surface including, a skirt part bent substantially at a right angle starting from a periphery of the effective surface part to a seal edge line of the panel through a mold match line, wherein the panel meets the following conditions.

$$Rdo/(USDd\times 1.75)\geqq 35, \text{ and } 0.5\leqq(MMLHu/CFT)\leqq 3.0,$$

Where, Rdo denotes a radius of curvature of the outside surface of the panel in a diagonal direction, USDd denotes a length of the effective surface part of the panel in the diagonal direction, MMLHU denotes a height from a center of the outside surface of the panel to the mold match line of the panel, and CFT denotes a thickness of the panel at the center.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
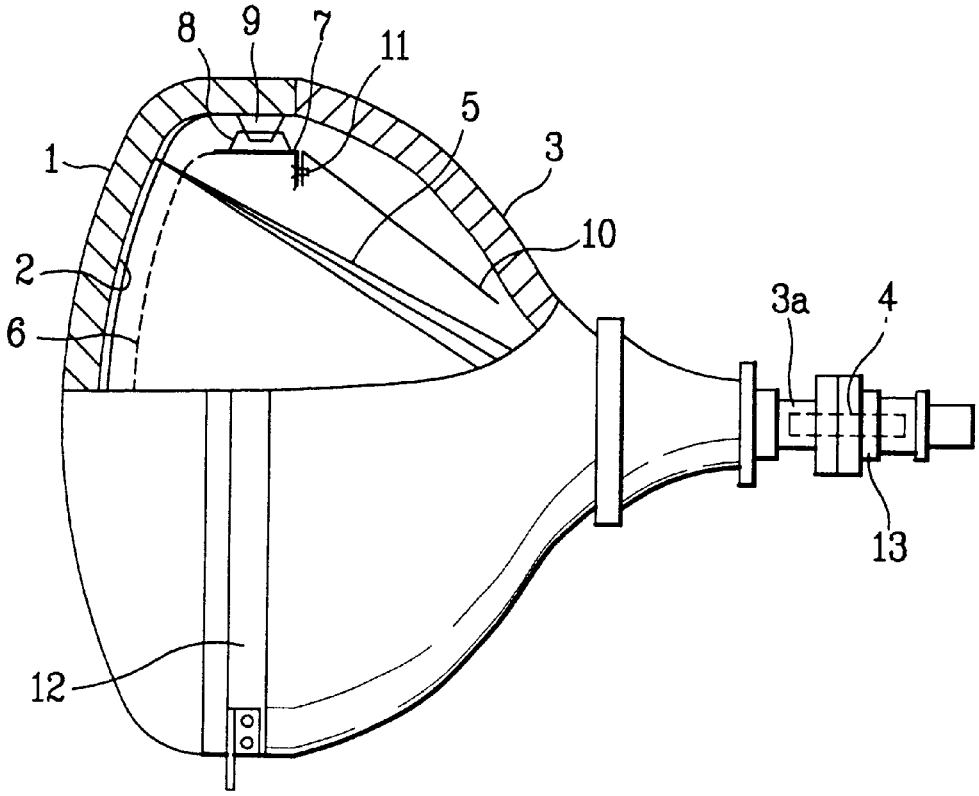
FIG.1 Prior Art
FIG. 1 illustrates a side view with a partial cut away view of a related art color cathode ray tube.
Figure 2:
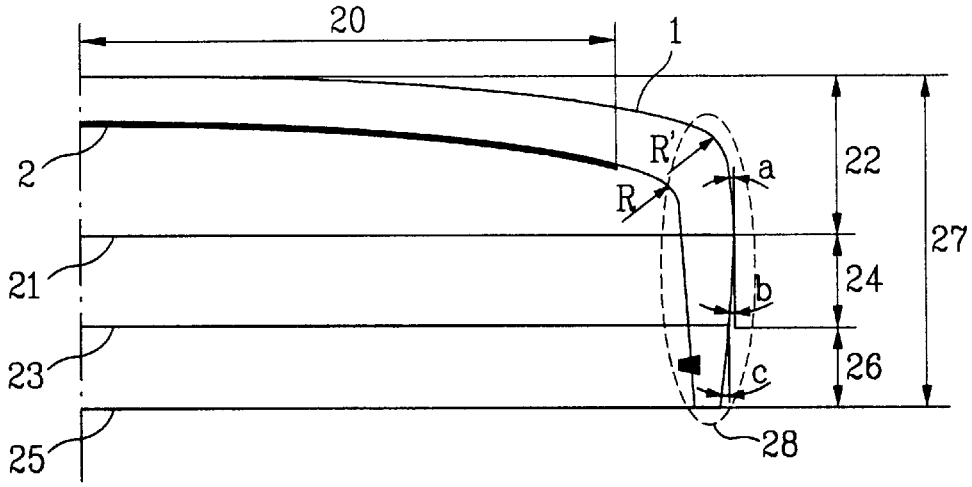
FIG.2 Prior Art
FIG. 2 illustrates a section of key parts of a panel structure in a related art color cathode ray tube.
Figure 3:
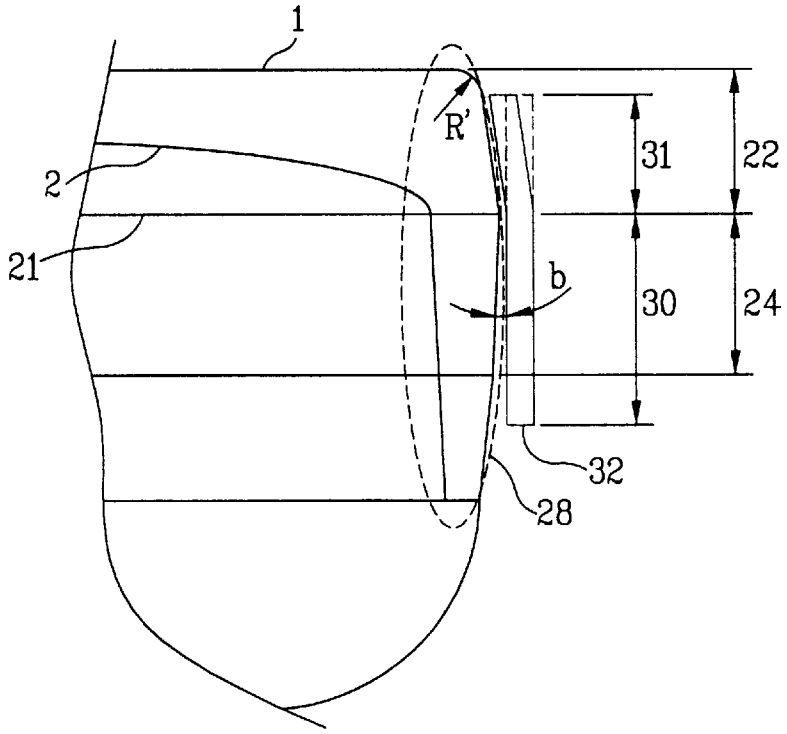
FIG.3 Prior Art
FIG. 3 illustrates a section showing a reinforcing band on a sidewall of a panel in a related art color cathode ray tube.
Figure 4:
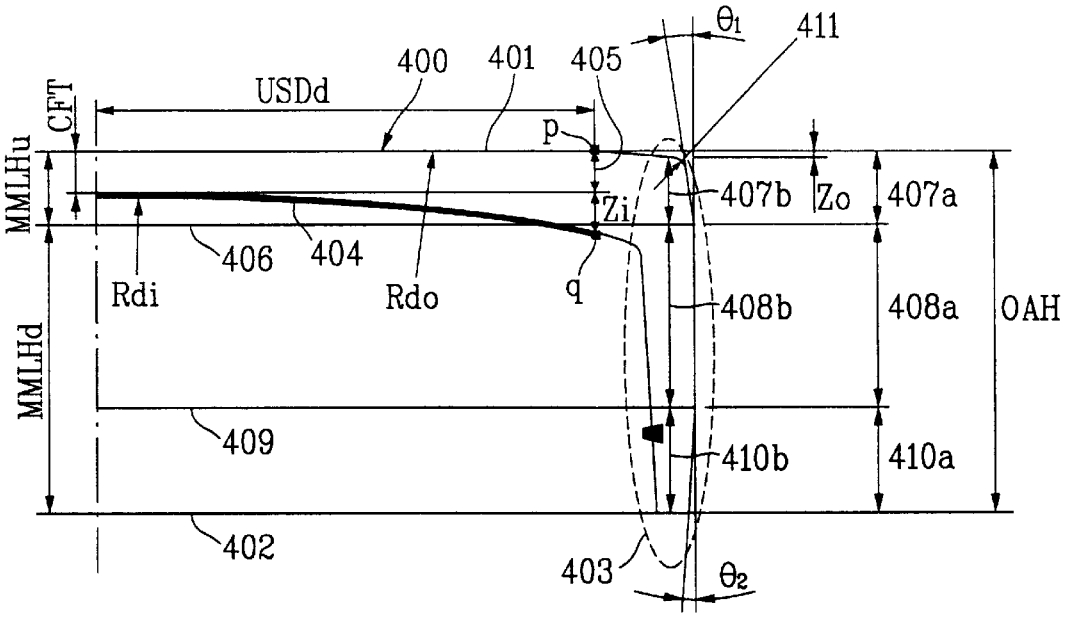
FIG. 4 illustrates a section of key parts of a panel structure in a flat cathode ray tube in accordance with a preferred embodiment of the present invention; and, FIG. 5 illustrates a section showing a reinforcing band on a sidewall of a panel in a flat cathode ray tube in accordance with a preferred embodiment of the present invention.

Reference will now be made in detail to the preferred embodiments of the present invention, examples of which are illustrated in the accompanying drawings. FIG. 4 illustrates a section of key parts of a panel structure in a flat cathode ray tube in accordance with a preferred embodiment of the present invention.

Referring to FIG. 4, a rectangular panel 400 of the present invention includes a panel inside surface part 404 positioned at an inside of the panel 400 with a radius Rdi of curvature, a panel front surface part 401 positioned at a front of the panel 400 with a radius Rdo of curvature, and a skirt part 403 formed substantially straight from an end of the front part 401 to a seal edge line 402. An effective surface part USDd having fluorescent material screen is formed at the front surface part 401, and a mold match line 406 is formed at a position higher than a position of an intersection 'q' between a vertical line 405 drawn from an end of the effective surface part USDd and the panel inside surface 404. The panel has an upper part 407*a* with a height made smaller as a mold match line 407 moves up toward the panel front surface formed above the mold match line 406, and an intermediate part 408*a* with a height made greater as the height of the upper part 407*a* of the panel is made smaller is formed below the mold match line 406. A break line 409 formed below the mold match line 406 of the panel forms a lower boundary of the intermediate part 408*a,* and a lower part 410*a* of the panel is formed between the break line 409 and the seal edge line 402 formed below the break line 409.

Meanwhile, the panel 400 has skirt parts 403 on opposite sides thereof, which can be divided in the same fashion. That is, the skirt part 403 may be divided into a skirt top part 407*b* starting from the end of the effective surface part USDd to the mold match line 408 to have a dimension the same with the height of the upper part 407*a* of the panel, a skirt middle part 408*b* continued from the skirt top part 407*b* to the break line 409, and a bottom part 410*b* continued from the skirt middle part 408*b* and extended to the seal edge line 402.

In the meantime, the foregoing panel 400 is required to meet design criteria shown below for providing a maximum implosion proof efficiency.

Design Criteria 1

$$Rdo/(USD\times 1.75)\geqq 35$$

Where, Rdo denotes a radius of curvature of the outside surface of the panel, and USDd denotes a length of the effective surface part of the panel having the screen formed thereon in a diagonal direction.

Design Criteria 2

$$1.32\leqq(CFT+Zi-Zo)/CFT\leqq 2.0$$

Where, Zi denotes a height from a center of the inside surface 404 of the panel to a 'q' point, and Zo denotes a height from a center of outside surface 401 of the panel to a 'p' point, CFT denotes a thickness of the panel at the center of the panel, the 'p' denotes an end point of the USDd on the outside surface of the panel 401, and the 'q' denotes a point of intersection between a vertical line 405 to the USDd drawn from the 'p' point with the inside surface 404 of the panel.

Design Criteria 3

$$0.5\leqq(MMLHu/CFT)\leqq 3.0$$

Where, MMLHu denotes a height from the center of the outside surface of the panel to the mold match line 406, MMLHd denotes a height from the seal edge line 402 to the mold match line 406, and OAH denotes a total height of the panel.

Design Criteria 4

MMLHd and OAH have the following relation.

$$0.7 \leqq (MMLHd/OAH) \leqq 0.9$$

In the meantime, there is an OBR 411 of a radius of curvature between the effective surface part USDd and the skirt top part 407*b* for smooth transition between a periphery of the effective surface part USDd and the skirt part 403, and a side surface of the top part 407*b* connecting an end of the OBR 411 to the mold match line 408 with a straight line is sloped toward an inside of the panel at an angle $\theta_1$ to the tube axis of the cathode ray tube.

Figure 5:
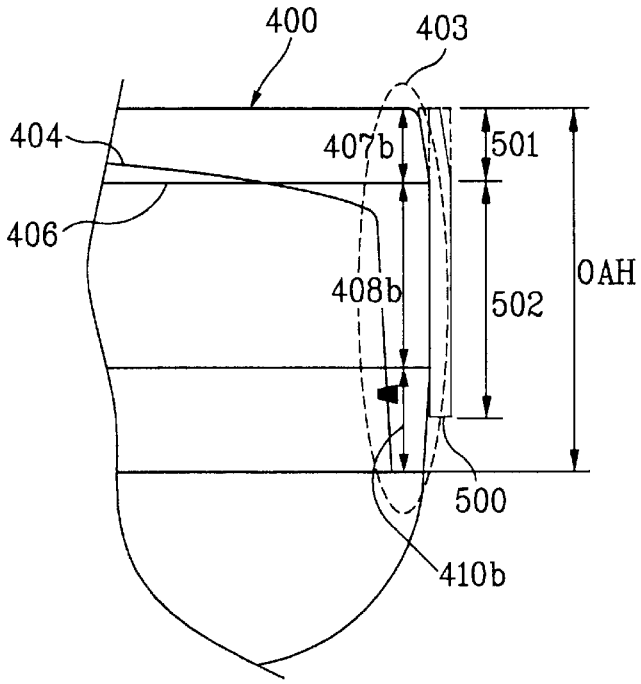

The work of the implosion proof panel in a cathode ray tube of the present invention will be explained, with reference to FIGS. 4 and 5.

Since a ratio of the skirt top part 407*b* of the panel is reduced in comparison to a total height OAH of the panel, a height of a bent part 501 of the reinforcing band strapped on the skirt top part 407*b* is reduced, leading the stress on the skirt part 403 concentrated onto the middle part 502 of the reinforcing band 500 work of the tension thereon is effective when the outward expansion force is generated as the inside space of the cathode ray tube is evacuated. Moreover, since a ratio of stress on the top part 407*b* of the skirt part 403 is reduced to an entire stress, an implosion proof efficiency is enhanced for the same reinforcing band.

As has been explained, the implosion proof panel in a cathode ray tube of the present invention can suppress implosion of the panel during or after fabrication to provide a panel of a high implosion proof performance without cost or weight of the cathode ray tube increased as a thickness of the skirt top part is increased or strengthening the reinforcing band for compensating an efficiency deterioration of the reinforcing band caused by a related art panel structure for solving the problem of weakening of the panel to a stress as the front part of the panel is made flat, thereby permitting to reduce a panel weight increased as a size of the flat cathode ray tube become larger, to allow to provide a light flat cathode ray tube, and to prevent the reinforcing band from slipping off the panel as the upper part of the panel is increased as the front part of the panel is made flat.

It will be apparent to those skilled in the art that various modifications and variations can be made in the implosion proof panel in a cathode ray tube of the present invention without departing from the spirit or scope of the invention. Thus, it is intended that the present invention cover the modifications and variations of this invention provided they come within the scope of the appended claims and their equivalents.

What is claimed is:

1. An implosion proof panel in a cathode ray tube, the cathode ray tube comprising:

an effective surface part of a fluorescent screen formed on the panel;

the panel with a substantially flat outside surface including, a skirt part starting from a periphery of the effective surface part to a seal edge line of the panel having an upper part, an intermediate part, and a lower part, the upper part and the intermediate part being divided by a mold match line; and, a reinforcing band strapped around an outer circumference of the panel for preventing implosion of the cathode ray tube, wherein the panel meets the following conditions $$Rdo/(USDd \times 1.75) \geqq 35, \text{ and } 0.7 \leqq (MMLHd/OAH) \leqq 0.9,$$

where, Rdo denotes a radius of curvature of the outside surface of the panel in a diagonal direction, USDd denotes a length of the effective surface part of the panel in the diagonal direction, MMLHd denotes a height from the seal edge line to the mold match line of the panel, and OAH denotes a total height of the panel.

2. An implosion proof panel as claimed in claim 1, wherein the panel meet the following condition $$1.32 \leqq (CFT+Zi-Zo)/CFT \leqq 2.0$$

where, Zi denotes a height from a center of the inside surface of the panel to a 'q' point, and Zo denotes a height from a center of the outside surface of the panel to a 'p' point, CFT denotes a thickness of the panel at the center of the panel, the 'p' denotes an end point of the USDd on the outside surface of the panel, and the 'q' denotes a point of intersection between a vertical line to the USDd drawn from the 'p' point with the inside surface of the panel.

3. An implosion proof panel in a cathode ray tube, the cathode ray tube comprising:

an effective surface part of a fluorescent screen formed on the panel; and, the panel with a substantially flat outside surface including, a skirt part bent substantially at a right angle starting from a periphery of the effective surface part to a seal edge line of the panel through a mold match line;

wherein the panel meets the following conditions $$Rdo/(USDd \times 1.75) \geqq 35, \text{ and } 0.5 \leqq (MMLHu/CFT) \leqq 3.0,$$

where, Rdo denotes a radius of curvature of the outside surface of the panel in a diagonal direction, USDd denotes a length of the effective surface part of the panel in the diagonal direction, MMLHU denotes a height from a center of the outside surface of the panel to the mold match line of the panel, and CFT denotes a thickness of the panel at the center.

4. An implosion proof panel as claimed in claim 3, wherein the panel meet the following condition $$1.32 \leqq (CFT+Zi-Zo)/CFT \leqq 2.0$$

where, Zi denotes a height from a center of the inside surface of the panel to a 'q' point, and Zo denotes a height from a center of the outside surface of the panel to a 'p' point, CFT denotes a thickness of the panel at the center of the panel, the 'p' denotes an end point of the USDd on the outside surface of the panel, and the 'q' denotes a point of intersection between a vertical line to the USDd drawn from the 'p' point with the inside surface of the panel.

* * * * *